US008567923B2

(12) United States Patent
Drury et al.

(10) Patent No.: US 8,567,923 B2
(45) Date of Patent: Oct. 29, 2013

(54) METHOD AND APPARATUS FOR DROPLET DEPOSITION

(75) Inventors: Paul Raymond Drury, Royston (GB); Julian Richard Bane, Elsworth (GB); Alison Diane Morris, Cambridge (GB)

(73) Assignee: Xaar Technology Limited, Cambridgeshire (GB)

( * ) Notice: Subject to any disclaimer, the term of this patent is extended or adjusted under 35 U.S.C. 154(b) by 136 days.

(21) Appl. No.: 13/127,829

(22) PCT Filed: Nov. 12, 2009

(86) PCT No.: PCT/GB2009/051526

§ 371 (c)(1),
(2), (4) Date: Jul. 14, 2011

(87) PCT Pub. No.: WO2010/055344

PCT Pub. Date: May 20, 2010

(65) Prior Publication Data

US 2011/0261119 A1 Oct. 27, 2011

(30) Foreign Application Priority Data

Nov. 12, 2008 (GB) ..... 0820714.4

(51) Int. Cl.
*B41J 2/045* (2006.01)
*B41J 2/205* (2006.01)

(52) U.S. Cl.
USPC ..... 347/68; 347/15

(58) Field of Classification Search
USPC ..... 347/10, 69
See application file for complete search history.

(56) References Cited

U.S. PATENT DOCUMENTS 5,512,922 A 4/1996 Paton
2004/0155915 A1 8/2004 Kitami et al.

FOREIGN PATENT DOCUMENTS

EP 0 422 870 A2 4/1991
EP 0 936 069 A2 8/1999

(Continued)

OTHER PUBLICATIONS

Search Report for Application No. GB0820714.4, dated Feb. 26, 2009.

(Continued)

*Primary Examiner* — Lisa M Solomon
(74) *Attorney, Agent, or Firm* — Marshall, Gerstein & Borun LLP

(57) ABSTRACT

A method for depositing droplets onto a substrate employs an apparatus, such as an inkjet printhead, the apparatus having: an array of channels, acting as fluid chambers, separated by interspersed walls, with each channel communicating with an aperture or nozzle for the release of droplets of a fluid contained within the channel, such as ink. Each of the walls separates two neighboring channels and is actuable such that, in response to a first voltage, it will deform so as to decrease the volume of one channel and increase the volume of the other channel, and, in response to a second voltage, it will deform so as to cause the opposite effect on the volumes of the neighboring channels. The method includes the steps of: receiving input data, such as an array of image data pixels; selecting pairs of adjacent channels based on the input data; assigning the selected pairs of adjacent channels as firing channels and the remaining channels as non-firing channels. While the pairs of firing channels may generally have any spacing, one of the pairs of firing channels is spaced apart from another of the pairs of firing channels by an odd number of non-firing channels. Within each of these selected pairs, the separating wall of that pair is actuated so as to cause the release of at least one droplet from each of said firing channels. The actuations for all the pairs overlap in time so as to ensure a high level of throughput or printing speed.

15 Claims, 6 Drawing Sheets

(56) References Cited

FOREIGN PATENT DOCUMENTS

| | | |
|---|---|---|
| EP | 1693202 | 8/2006 |
| WO | WO-99/12738 A1 | 3/1999 |
| WO | WO-2006129071 | 12/2006 |
| WO | WO-2007/007074 A1 | 1/2007 |

OTHER PUBLICATIONS

International Search Report and Written Opinion for PCT/GB2009/051526 dated Mar. 11, 2010.

Screening

METHOD AND APPARATUS FOR DROPLET DEPOSITION

The present invention relates to a method and apparatus for droplet deposition and may find particular use within apparatus including fluid chambers separated by actuable piezoelectric walls.

In a particular example, the present invention relates to ink jet printers.

It is known within the art of droplet deposition apparatus to construct an actuator comprising an array of fluid chambers separated by a plurality of piezoelectric walls. In many such constructions, the walls are actuable in response to electrical signals to move towards one of the two chambers that each wall bounds; such movement affects the fluid pressure in both of the chambers bounded by that wall, causing a pressure increase in one and a pressure decrease in the other.

Nozzles or apertures are provided in fluid communication with the chamber in order that a volume of fluid may be ejected therefrom. The fluid at the aperture will tend to form a meniscus owing to surface tension effects, but with a sufficient perturbation of the fluid this surface tension is overcome allowing a droplet or volume of fluid to be released from the chamber through the aperture; the application of excess positive pressure in the vicinity of the aperture thus causes the release of a body of fluid.

An exemplary construction having an array of elongate chambers separated by actuable walls is shown in FIG. 1. The chambers are formed as channels enclosed on one side by a cover member that contacts the actuable walls; a nozzle for fluid ejection is provided in this cover member. The cover member will often comprise a metal cover plate, which provides structural support, and a thinner overlying nozzle plate, in which the nozzles are formed.

As shown in FIG. 1, the actuation of the walls of a chamber may cause the release of fluid from that chamber through its aperture. In the case shown in FIG. 1, both the walls of a particular chamber are deformed inwards, this movement causing an increase in the fluid pressure within the channel and a decrease in pressure of the two neighbouring channels. The increase in pressure within that chamber contributes to the release of a droplet of fluid through the aperture of that chamber.

In constructions such as FIG. 1 where all chambers are provided with an aperture, every chamber may be capable of fluid release. It will be apparent however, that since the actuation of a particular wall has a different effect on the pressure in its two adjacent channels, simultaneous release of fluid from both of the channels separated by a particular wall is difficult to achieve.

There may be some asymmetry in the design of the apparatus to enable droplets released at different times to arrive on a substrate at the same time; for example, the nozzles may be located in different positions for different channels. During deposition the array will be moved perpendicular to the array direction, thus two nozzles may be spaced in the direction of movement so that the spacing in position counteracts the difference in timing of droplet release. However, such constructional changes are permanent for an actuator and are thus able to compensate for only a specific pattern of droplet release timings; this leads to restriction of the methods used to drive the actuator walls.

A further complication caused by the actuation of a wall shared by two chambers is that residual pressure disturbances remain in the chamber after the actuation has occurred. Experiments carried out by the Applicant have led to the data shown in FIG. 2 for the displacement within a fluid (acting as a proxy for the pressure within the fluid) in two neighbouring chambers following a single movement of the dividing wall. It is apparent from these data that the pressure in each chamber oscillates about the equilibrium pressure (the pressure present in a chamber where no deformation of the walls takes place), with the amplitude of oscillation decaying to zero over time. The time taken for the amplitude to decay to zero is referred to hereinafter as the relaxation time ($t_R$) for the system.

Without wishing to be bound by the theory the Applicant believes that the oscillation of pressure is caused by pressure standing waves set up by acoustic waves reflected within the fluid chamber. The period ($T_A$) of these standing waves may be derived from a graph such as FIG. 2 and is known as the acoustic period for the chamber. In the case of a long, thin channel this period is approximately equal to l/c where l is the length of the channel and c is the speed of sound within the chamber.

As mentioned above, residual pressure waves are present in both chambers either side of a wall following the movement of that wall. The presence of such residual waves is apparent from the second and subsequent maxima in displacement shown in FIG. 2. Therefore, when fluid is released from a particular chamber, pressure disturbances may be present in one or both of the neighbouring chambers. For example, in some actuation schemes fluid is released from a particular chamber by the inward movement of both walls bounding that chamber, which will affect the pressure in both the neighbouring chambers. These pressure disturbances may interfere with fluid release from the neighbouring chambers in a process known as 'cross-talk'.

Actuator constructions have been proposed to ameliorate the problem of 'cross-talk'; for example, alternate chambers may be formed without apertures so that these 'non-firing' chambers act to shield the chambers with apertures—the 'firing' chambers—from pressure disturbances. It will of course be apparent that for a given chamber size this has the undesirable consequence of halving the resolution available.

EP 0 422 870 proposes to ameliorate cross-talk with actuation schemes that pre-assign each chamber to one of three or more groups or 'cycles'. The chambers in turn are cyclically assigned to one of these groups so that each group is a regularly spaced sub-array of chambers. During operation, only one group is active at any time so that chambers depositing fluid are always spaced by at least two chambers, with the spacing dependent on the number of groups. User input data determines which specific chambers within each group are actuated. In more detail, the chambers within a cycle chamber may each receive a different number of pulses corresponding to the number of droplets that are to be released by that chamber, the droplets from each chamber merging to form a single mark or print pixel on the substrate.

It will be apparent that at any one time only one third of the total number of chambers (or 1/n, where n is the number of cycles) may be actuated in this scheme and that therefore the rate of throughput is substantially decreased.

Additionally, the time delay between the firing of different groups can lead to the corresponding dots on the substrate being spaced apart in the direction of relative movement of the substrate and the apparatus. As noted briefly above, some apparatus constructions address this problem by offsetting the nozzles for each cycle, so that the nozzles for each cycle lie on a respective line, the lines being spaced in the direction of substrate movement, while this often successfully counteracts this particular problem, this construction is generally restricted to a particular firing scheme following nozzle formation.

EP 0 422 870 also proposes an actuator where the chambers are divided into two groups—odd-numbered and even-numbered chambers. Each group of chambers is synchronised to fire at the same time, with the specific input data determining which chambers within that group should be fired. The disclosure also discusses switching between the two groups at the resonant frequency of the chambers so that neighbouring chambers are fired in anti-phase.

It is noted in the document that this scheme grants a high throughput rate, but results in restrictions to the patterns that may be produced. For example, according to this scheme it is possible to print white-black-white, but not black-white-black.

Thus, there exists a need for a droplet deposition apparatus that has an increased throughput rate with less restriction in the patterns that may be produced.

The Applicant has recognised that in the case of the odd-even channel system proposed in EP 0 422 870, the division of the chambers into two groups allows the residual pressure fluctuations in neighbouring chambers to be used beneficially in promoting the ejection of fluid. The applicant has further recognised that the same fundamental benefits in terms of increased throughput may still be afforded when only an isolated pair of neighbouring chambers is operated at or close to the resonant frequency of the chambers. Therefore, a system can be devised where the actuation of an array of chambers comprises the actuation of a plurality of such pairs of neighbouring chambers.

The Applicant has also recognised that the symmetry of the odd-even channel scheme of EP 0 422 870 includes the symmetric deformation of both the walls of a particular channel in order to eject a droplet and that this symmetry leads in part to the restriction in the patterns that may be printed.

Thus, according to a first aspect of the present invention there is provided a method for depositing droplets onto a substrate, utilising an apparatus comprising:

an array of fluid chambers separated by interspersed walls, each fluid chamber being provided with an aperture and each of said walls separating two neighbouring chambers; wherein each of said walls is actuable such that, in response to a first voltage, it will deform so as to decrease the volume of one chamber and increase the volume of the other chamber, in response to a second voltage, it will deform so as to cause the opposite effect on the volumes of said neighbouring chambers; wherein each of said walls is actuable such that, in response to a first voltage, it will deform towards one of its two neighbouring chambers, thus decreasing the volume of that chamber and increasing the volume of the other chamber, in response to a second voltage, it will deform towards the other of its two neighbouring chambers, causing the opposite effect on the volumes of the neighbouring chambers;

the method comprising the steps of:

receiving input data;

selecting pairs of adjacent fluid chambers based on said input data, assigning said selected pairs of adjacent fluid chambers as firing chambers and the remaining fluid chambers as non-firing chambers, wherein one of said pairs of firing chambers is spaced apart from another of said pairs of firing chambers by an odd number of non-firing chambers;

for each of said selected pairs, actuating the separating wall of said pair of firing chambers so as to cause the deposition of at least one droplet from each of said firing chambers;

wherein said actuations of said selected pairs overlap in time.

Depositing drops by actuating the dividing wall of a pair of neighbouring chambers advantageously allows pairs to be spaced by one chamber only and thus it is possible to print black-white-black, so increasing the patterns that may be produced. More, selected pairs may be spaced by any number of chambers so that there is no longer an assignment of odd and even chambers, this difference being particularly apparent as the pairs may be spaced apart by an odd number of chambers.

Further, by taking account of the input data in determining which pairs should be selected, the procedure may be optimised so as to minimise the effect of any remaining restrictions on patterns.

In contrast to known apparatus discussed above, apparatus adapted to carry out a method according to the present invention may advantageously have the apertures for substantially all fluid chambers are disposed on a line, thus greatly simplifying integration of the print head or other droplet deposition apparatus within a printer or other larger system and also allowing a variety of actuation schemes falling within the scope of the present invention to be used.

The invention will now be described with reference to the accompanying drawings, in which.

Figure 7:
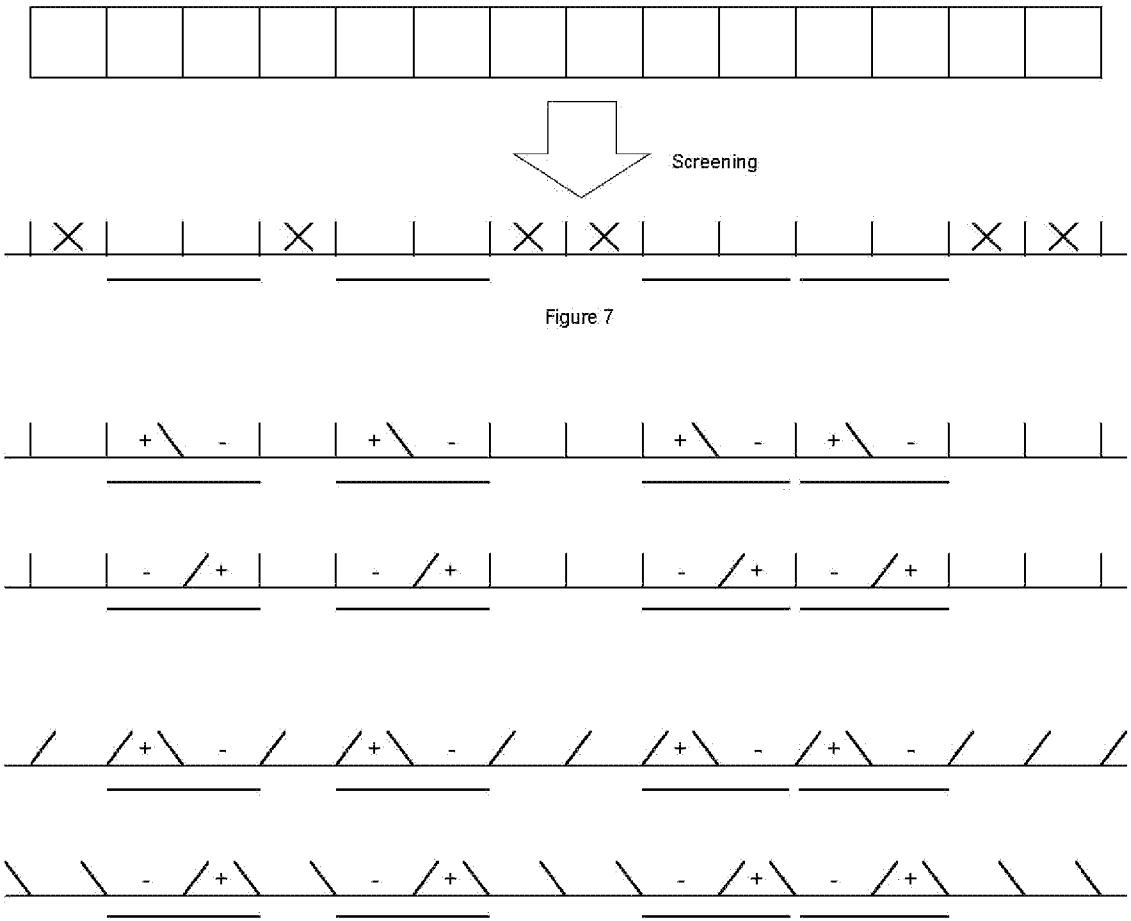
FIG. 7 illustrates a method of converting input data into actuations in accordance with a first embodiment of the present invention.
Figures 10, 11A, 11B:
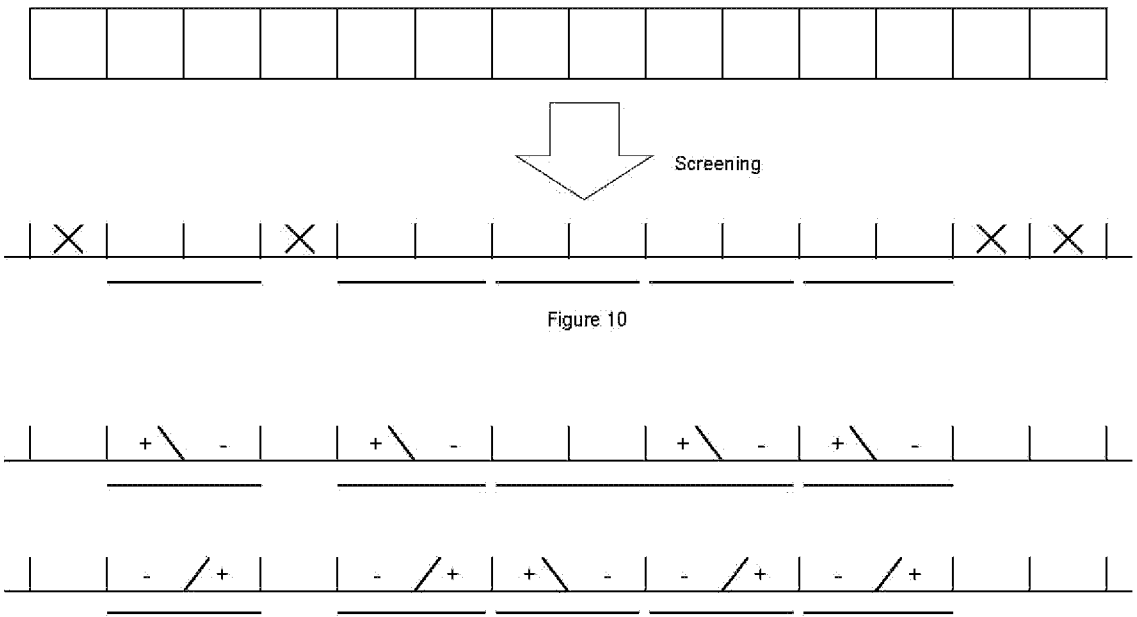
Figure 12:
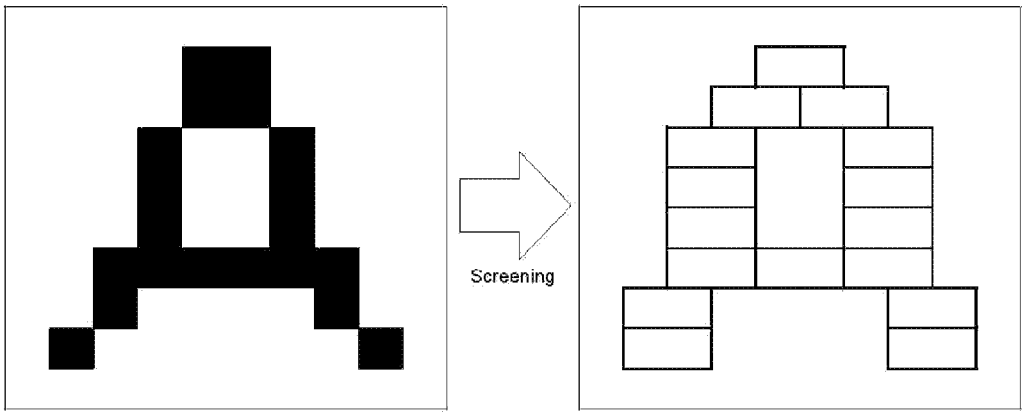
Figure 13:
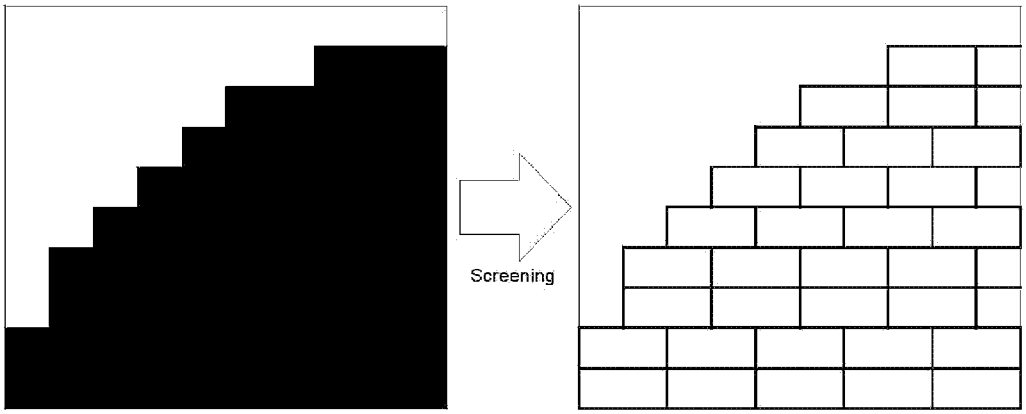
Figure 14:
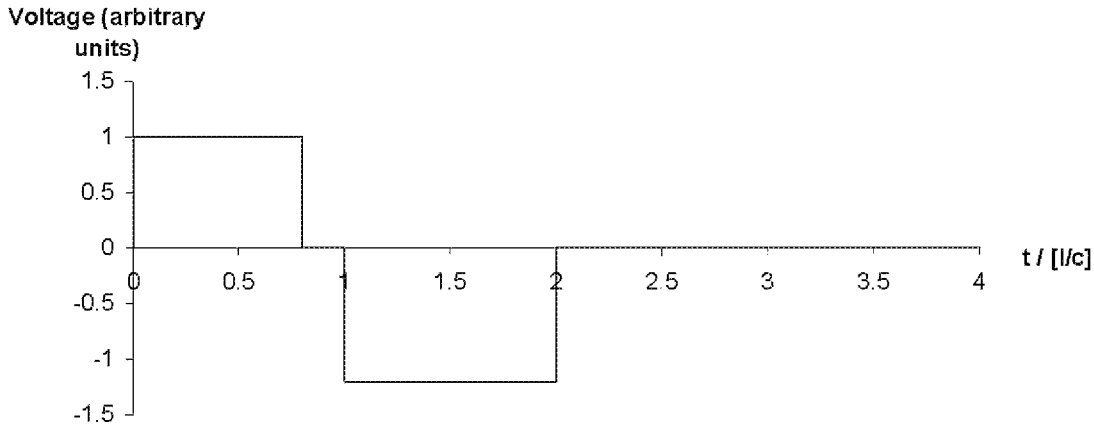
Figure 15:
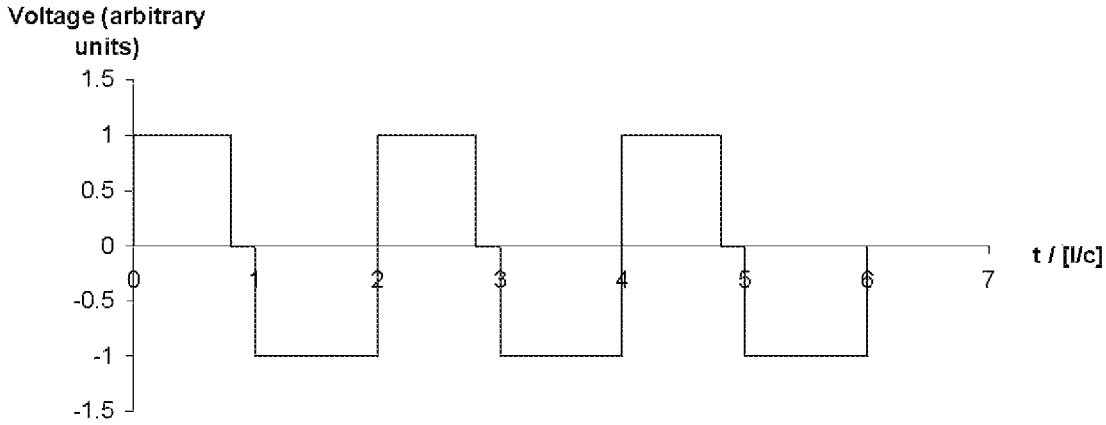
Figure 16:
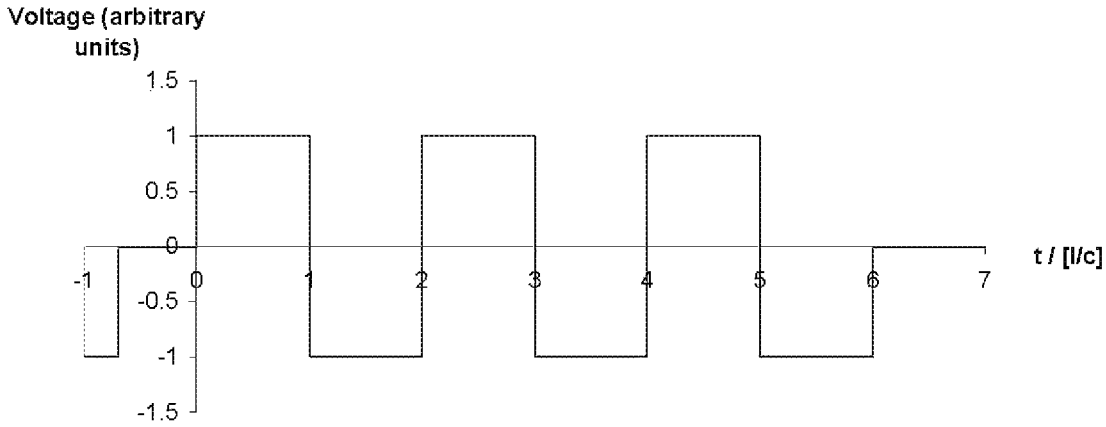

FIGS. 8(*a*) and 8(*b*) are representations of a method of operating a droplet deposition apparatus in accordance with the embodiment of FIG. 7;

FIGS. 9(*a*) and 9(*b*) are representations of a method of operating a droplet deposition apparatus in accordance with a further embodiment of the present invention using the same input data as FIGS. 7 and 8, but where all walls are continuously active;

FIG. 10 illustrates a method of converting input data into actuations in accordance with a further embodiment of the present invention, where a single droplet may be released from a selected pair of chambers;

FIGS. 11(*a*) and 11(*b*) are representations of a method of operating a droplet deposition apparatus in accordance with the embodiment of FIG. 10;

FIGS. 12 and 13 illustrate respectively the effect on text and images of a method of converting input data in accordance with the present invention;

FIG. 14 shows a voltage waveform that may be applied to a pair of chambers being actuated according to the method of FIG. 8;

FIG. 15 shows a voltage waveform according to a still further embodiment of the present invention comprising a series of alternating positive and negative portions;

FIG. 16 shows a voltage waveform according to yet a further embodiment of the present invention where a non-ejection waveform portion precedes a series of positive and negative waveform portions.

Figure 1:
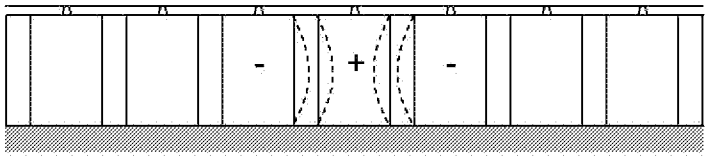
Figure 1 (PRIOR ART)
FIG. 1 shows a known construction of a droplet deposition apparatus.

The apparatus shown in FIG. 1 may be used to carry out a method of droplet deposition in accordance with the present invention. The apparatus of FIG. 1 comprises an array, extending in an array direction, of fluid chambers formed as channels or elongate chambers, each having a longitudinal axis extending in a channel extension direction. The channel extension direction will preferably be perpendicular to the array direction. The channels are separated by a corresponding array of elongate channel walls formed of a piezoelectric material (such as PZT) so that each channel is thus provided with two opposed side walls running along the length of the chamber.

In order to provide maximal density of deposited droplets, preferably every channel or chamber within the array is filled with an ejection fluid, such as an ink, during use and provided with an aperture or nozzle for ejection of the fluid.

Apparatus such as that depicted in FIG. 1 is commonly referred to as a 'side-shooter' owing to the placement of the nozzle in the side of the fluid chambers. In such constructions, the ends of the channels will often be left open to allow all channels to communicate with one or more common fluid manifolds. This further allows a flow to be set up along the length of the channel during use of the apparatus so as prevent stagnation of the fluid and to sweep detritus within the fluid away from the nozzle. It is often found to be advantageous to make this flow along the length of the channel greater than the flow through the nozzle due to ink release, and preferably to make this flow at least five or more preferably still, ten times greater.

In this particular construction each such channel is coated internally with a metal layer that acts as an electrode, which may be used to apply a voltage across the walls of that chamber and thus cause the walls to deflect or move by virtue of the piezoelectric effect. The voltage applied across each wall will thus be the difference between the signals applied to the adjacent channels. Where a wall is to remain undeformed, there must be no difference in potential across the wall; this may of course be accomplished by applying no signal to either of the adjacent channel electrodes, but may also be achieved by applying the same signal to both channels.

The piezoelectric walls may preferably comprise an upper and a lower half, divided in a plane defined by the array direction and the channel extension direction. These upper and lower halves of the piezoelectric walls may be poled in opposite directions perpendicular to the channel extension and array directions so that when a voltage is applied across the wall perpendicular to the array the two halves deflect in 'shear-mode' so as to bend towards one of the fluid chambers; the shape adopted by the deflected resembles a chevron.

Other methods of providing electrodes and poling walls have been proposed, which afford the ability to deflect the walls in a similar bending motion. For example, each wall may consist of two oppositely poled halves, where the halves are divided by a plane perpendicular to the array direction. In such a construction, electrodes may be provided at the top and bottom of each wall. Those skilled in the art will appreciate that different electrode schemes are effectively interchangeable and that chambers may be provided with more than one electrode depending on the requirements of the particular application.

Figure 3B:
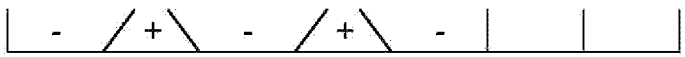
FIG. 3(*a*) shows the droplet deposition apparatus of FIG. 1 undergoing a different series of actuations, while FIG. 3(*b*) is a simplified representation of the same series of actuations.
Figure 3A:
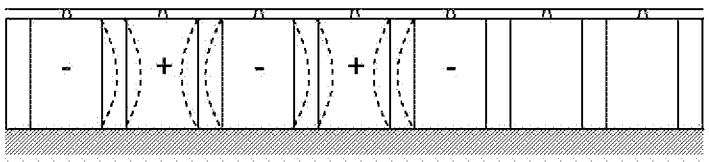

FIG. 3(*a*) shows the apparatus of FIG. 1 undergoing a different series of actuations, where two chambers experience an increase in pressure owing to inward movement of both of their walls leading to a decrease in the volume of those chambers. As may also be seen in the figure, this inward movement causes a pressure decrease in the neighbouring chambers as the same wall movement acts to increase the volumes of those chambers. FIG. 3(*b*) shows the same series of actuations using a simplified representation, where the walls are represented by diagonal or vertical lines: the direction of deflection of a wall is represented by the direction in which the line extends so that an undeformed wall is represented by a vertical line.

At this level of abstraction it becomes apparent that the invention is not limited to use with a specific actuator construction, but is more generally concerned with the operation of droplet deposition apparatus having deformable walls shared by neighbouring chambers within an array, the nature of the deformation being such that more volume is displaced in one chamber than the other chamber. Put differently, when compared to its undeformed or undeflected shape, the thus-deformed wall occupies more space in one chamber than in the other chamber.

Apparatus such as that depicted in FIG. 1 is commonly referred to as a 'side-shooter' owing to the placement of the nozzle approximately in the side of the fluid chambers; the nozzle is commonly provided equidistant of each end. In such constructions, the ends of the channels will often be left open to allow all channels to communicate with one or more common fluid manifolds. This further allows a flow to be set up along the length of the channel during use of the apparatus so as prevent stagnation of the fluid and to sweep detritus within the fluid away from the nozzle. It is often found to be advantageous to make this flow along the length of the channel greater than the maximum flow through the nozzle due to fluid release. Put differently, when the apparatus is operated at maximum ejection frequency the average flow of fluid through each nozzle is less than the flow along each channel. Preferably this flow is at least five or more preferably still, ten times greater than the maximum flow through the nozzle due to fluid release.

Figure 4B:
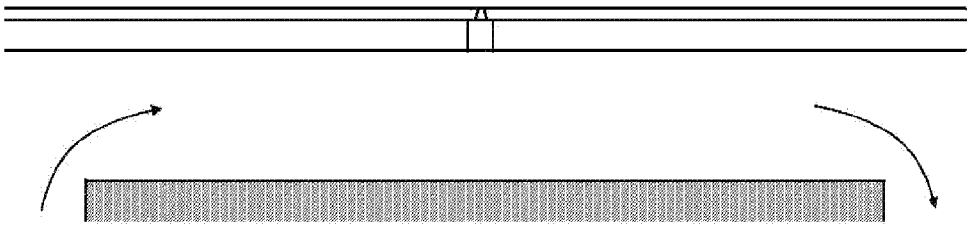
FIG. 4(*a*) shows an end-view and FIG. 4(*b*) a side-view of a still further exemplary construction of a droplet deposition apparatus where each chamber opens onto a manifold at opposing ends.
Figure 4A:
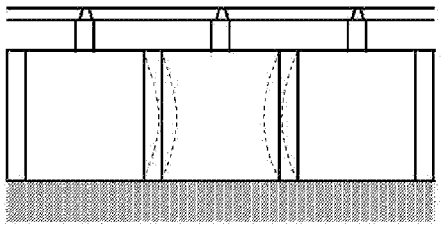

FIGS. 4(*a*) and 4(*b*) show a further example of a 'side shooter' construction, in which a cover plate encloses the array of chambers and a nozzle plate overlies this cover plate; for each chamber, a corresponding ejection port is formed in the cover plate, which communicates with the chamber and a nozzle to enable ejection of fluid from that chamber through the nozzle. The chambers open at either end of their lengths onto a common fluid supply manifold; separate common manifolds may be provided for each end or a single manifold for both ends may be provided. Movements of the piezoelectric walls separating the array of chambers generate acoustic waves within the chambers, which are reflected at the boundary between the chamber and the common manifold due to the difference in cross-section area. These reflected waves will be of opposite sense to the waves incident on the channel ends, owing to the 'open' nature of the boundary. Further, a flow of fluid along each chamber may be set up as described with reference to FIG. 1, as is shown in the view parallel to the array of channels in FIG. 4(*b*).

Figure 5B:
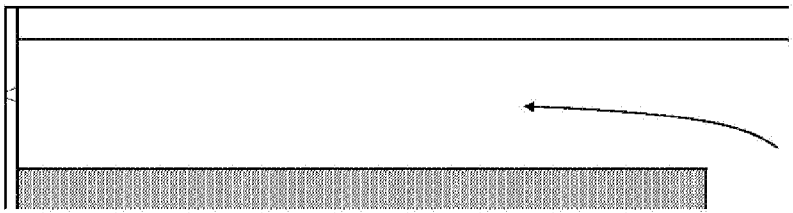
FIG. 5(*a*) shows an end-view and 5(*b*) a side-view of yet a further exemplary construction of a droplet deposition apparatus where each chamber opens onto a manifold at only one end.
Figure 5A:
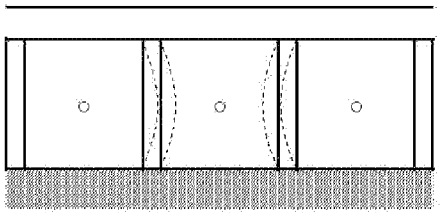

FIGS. 5(*a*) and 5(*b*) show an example of an 'end-shooter' construction, where nozzles are formed in a nozzle plate closing one end of each chamber, the other end of each chamber opening on to a fluid supply manifold common to all chambers. In certain 'end-shooter' constructions, such as that proposed in WO2007/007074, a small channel may be formed in the base in proximity to the nozzle for egress of fluid from the chamber. The channel is of much smaller cross-section than the chamber so as to effectively form a barrier to acoustic waves within the chamber. A flow of fluid may be set up along the length of each chamber, with fluid entering from the common manifold and leaving via the small channel provided adjacent each nozzle.

Figure 6B:
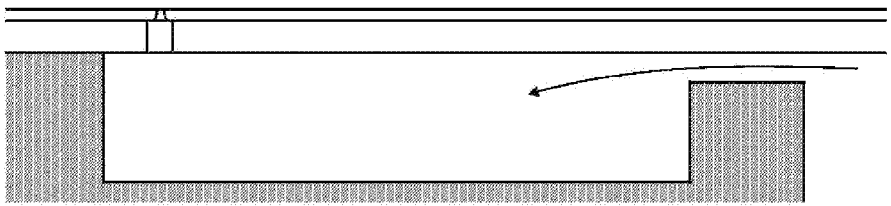
FIG. 6(*a*) shows an end-view and 6(*b*) a side-view of a still further exemplary construction of a droplet deposition apparatus where a small passage connects each chamber to a manifold.
Figure 6A:
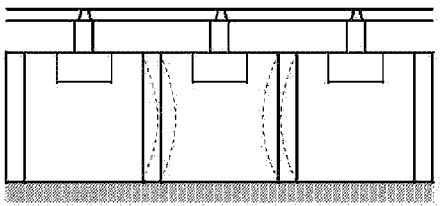

FIGS. 6(*a*) and 6(*b*) show a still further example of a droplet deposition apparatus that may be used in accordance with the present invention. This construction provides a nozzle plate and cover plate similar to that described with reference to FIGS. 4(*a*) and 4(*b*), but with each nozzle provided towards one end in the side of the corresponding chamber. A support member defines each channel base and substantially closes each chamber at both ends of its length, with the exception of a small channel provided at the opposite end of the chamber to the nozzle. This small channel allows the ingress of fluid for ejection from the chamber through the nozzle, but has a very much smaller cross-section than the chamber itself so as to act as a barrier to acoustic waves within the chamber from reaching the supply manifold. Any acoustic waves generated by movements of the piezoelectric walls will thus be reflected by both ends of the chamber as waves of the same sense.

It will be appreciated that the present invention is susceptible of use with all the above-described apparatus and more generally with apparatus comprising an array of chambers separated by actuable walls, where each chamber is provided with an aperture for droplet ejection.

As is noted above, many schemes have been proposed for the ejection of fluid from the nozzles of an array of fluid chambers divided by actuable walls.

FIG. 7 shows a schematic representation of a method of droplet deposition in accordance with a first embodiment of the present invention. There is displayed a line of image data pixels, which in this particular embodiment are either black or white. This line of image data pixels is then 'screened' or converted into a series of commands for the array of actuators pictured in FIG. 7. The fluid chambers of the actuator are shown schematically in FIG. 7, with vertical lines representing the channel separating walls.

Pairs of fluid chambers are selected according to the screening procedure, the locations of these pairs corresponding to the positions of the 'black' image pixels. For each pair of fluid chambers, the central dividing wall is actuated, as shown in FIGS. 8 and 9, moving backwards and forwards between the chambers so as to release a pair of droplets onto the substrate.

As will be apparent from the figure, all the pairs are separate and distinct, so that each fluid chamber is a member of at most one pair. In this way, the actuations within each pair may be physically isolated from actuations in other pairs. The pairs may be spaced apart by any number of non-firing chambers, but the use of the invention is indicated by the spacing apart of pairs of firing chambers by an odd number of non-firing chambers. This will, in general, produce a pattern of dots disposed on a grid on the substrate where two regions of regularly spaced dots, each region consisting of an even number of dots, are separated by a gap on the grid corresponding to the absence of an odd number of dots. This includes, for example, the situation where a black-black-white-black-black pattern is formed on the substrate.

The period of oscillation of the wall may advantageously be less than the relaxation time of the chamber so as to use the residual acoustic wave energy from previous wall movements to assist droplet release. Each of these active pairs is represented in FIG. 7 by a horizontal line beneath the two chambers of the pair; the remaining, inactive chambers are represented by an 'X'. The active pairs will correspond to a pair of dots in the pattern created on the substrate.

In more detail, FIGS. 8 and 9 both show two different methods of actuating the walls of the chambers so as to form a representation of the image in FIG. 7. In both methods the outer walls of a pair do not directly cause droplet ejection but are used for a different purpose, such as reinforcing ejection, preventing fluid stagnation, or reducing cross-talk.

FIGS. 8(*a*) and 8(*b*) show the walls of the chambers at two different points in time separated by one half of the actuation cycle. It is therefore apparent that the central dividing walls of the selected pairs are actuated, while the remaining walls are not actuated. Thus the outer walls of each pair remain substantially still and undeformed during actuation of the central wall. In this way, the outer walls act as a barrier to pressure disturbances caused by the actuation of the central wall, thus preventing cross-talk with chambers outside of the pair. In a construction where a single electrode addresses each channel, it is therefore a requirement that identical signals be applied to the channel electrodes either side of the wall to be held still.

FIGS. 9(*a*) and 9(*b*) also show chambers at two points one half-cycle apart, but in an actuation scheme where all walls are actuated. According to this embodiment, all the walls of non-firing chambers—and thus the outer walls of the selected pairs—are constantly actuated in phase. This motion prevents the stagnation of fluid within the non-firing chambers, which might otherwise lead to the blockage of the apertures of those chambers. The separating wall of the firing pair moves in opposition to this motion so as to cause ejection from each chamber, with the additional energy imparted by the non-firing walls reinforcing the firing actuation.

It will be apparent that where three black image pixels appear together these may be screened as either one or two active pairs. In the embodiment of FIG. 7, the three pixels are represented by two active pairs, with the extra droplet filling one of the spaces corresponding to the two blank pixels in the image. The screening procedure may take account of the amount of neighbouring blank space so as to ensure that the error is less visible in the printed pattern—for example, it may prevent single 'white' image pixels from being represented as with a droplet. It will be appreciated that in this embodiment the narrowest region of print available is two droplets wide, but it has been found that the resultant degradation in printed image quality is often negligible.

For example, FIGS. 12 and 13 show respectively the character 'A' and the edge of a circle when screened into a plurality of pairs of print pixels. It will be apparent that the error in this conversion is negligible even at this level of magnification and so the errors in the pattern formed on the substrate are unlikely to be perceptible. In some cases, the image may be pre-processed so as to optimise it for such a printing method. For example, where text is to be printed, optimised fonts may be used.

In situations in which it is not possible to deposit only one droplet from a pair there will be an inherent error in representing a single pixel as either a pair of droplets or no droplets at all. The screening algorithm may transfer this error to adjacent lines of image data in an error distribution process such as dithering.

By contrast to some previously suggested actuation schemes, the actuation may advantageously occur at sufficiently high frequency that fluid droplets are released from the two chambers with a time difference less than the relaxation time for the chambers. The Applicant has recognised that where chambers are paired in this manner, the residual pressure waves produced when a wall moves towards a first chamber may be used advantageously to perturb the meniscus at the aperture of the second chamber in the pair. By moving the dividing wall towards the second chamber at an appropriate time the pressure waves—rather than causing interference or 'cross-talk'—thus encourage controlled fluid release.

Figure 2:
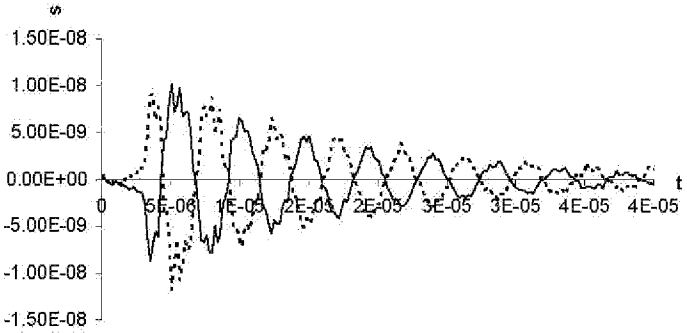
FIG. 2 shows the pressure response in two neighbouring chambers to the deformation of the wall separating the chambers.

Preferably the time period taken for the wall to move from the first chamber to the second and then return—the actuation period—is chosen to lie in the range of 0.5 to 1.5 acoustic periods. As may be seen from FIG. 2 it is at this point that the pressure in the second chamber is at or near a maximum, thus favouring controlled ejection. It may be preferable to utilise an actuation period close to, but differing from the acoustic period so as to avoid resonant behaviour within the chamber. It has been found that actuating at resonance may in some circumstances cause fluid droplets to be released with ever increasing speeds, thus leading to unstable droplet deposition.

As mentioned above, the acoustic period for a chamber may be determined by providing a single impulse to a chamber by a single movement of an actuating wall towards that chamber: the period of pressure oscillations within the chamber is the acoustic period. For a long, thin chamber or channel of length L the acoustic period is approximately L/c, where c is the speed of sound in the fluid.

FIG. 15 displays a voltage waveform that may be applied across a separating wall in the embodiments shown in FIGS. 7 to 11. In the case of an electrode structure as described with reference to FIG. 1, this waveform corresponds to the potential difference between the signals at the adjacent channel electrodes. Where it is desired to produce a bipolar voltage across a wall with such a construction, this may be accomplished by applying one uni-polar signal to each of the neighbouring electrodes, so that one signal provides positive portions of the voltage across the wall and the other signal provides negative portions.

There is a direct relationship between the voltage and the position of the wall: where the voltage is held at zero the wall is undeformed; where the voltage is held at a positive value the wall is deformed towards the first chamber and where the voltage is held at a negative value the wall is deformed towards the second chamber. The movement of the wall will tend to lag behind the voltage signal owing to the response time of the system.

The signal applied across the dividing wall comprises two square wave portions: a first, positive portion that causes the wall to move from its undeformed state towards the first chamber and then return to its undeformed state; and a second, negative portion that causes the wall to move from its undeformed state towards the second chamber and again to return to its undeformed state. Where the time spacing between first and second portions is of a similar magnitude to the response time of the system the wall may move directly from deformation towards the first chamber to deformation towards the second chamber with no appreciable pause in its undeformed state, and may thus be considered a single continuous movement from first chamber to second.

As is shown in FIG. 14, the beginning of the second square wave portion is one acoustic length after the beginning of the first square wave. It is apparent from FIG. 2 that this enables the movement of the wall towards the second chamber to be to an extent coincident with a pressure maximum in the second chamber caused by the first pulse.

In more detail, the initial deformation towards the first chamber will cause an instantaneous increase in the pressure of the first chamber and a decrease in the pressure of the second chamber, but will also create inwardly moving positive pressure acoustic waves at the open ends of the second channel. These acoustic waves will travel inwards and converge upon the nozzle of the second channel after half an acoustic period (half an acoustic period corresponds to the time taken for the waves to reach the centre of the channel, where the nozzle is located). This point corresponds to the pressure maximum shown in FIG. 2. The dividing wall then moves back towards the second channel to instantaneously increase the pressure in the second channel and decrease the pressure in the first channel. The combination in the second channel of the positive acoustic wave present at the nozzle and the positive pressure generated by the wall movement is sufficient to cause release of a droplet.

Given suitable flexibility in the drive electronics producing such voltage signals it is possible to alter the relative speeds of the fluid droplets produced by the first and second chambers. For example, in the voltage waveform of FIG. 14 both the amplitude and the length of the second square wave portion is greater than that of the first square wave portion. During operation, the array of fluid chambers is moved relative to a substrate during deposition of fluid droplets on that substrate; with suitable alteration of the parameters of the square waves it is possible to ensure that the difference in droplet speeds counterbalances the difference in timing of the release of the droplets. Thus it is possible to ensure that—for a given speed of movement—the droplets are deposited so as to form dots on a single straight line on the substrate.

There may, of course, remain some small offset of the dots in the direction of relative movement of the substrate and the apparatus, but this will be small when compared to the diameter of the dot formed, or at the least there will not be space separating the dots in the substrate movement direction.

Conversely, there may exist situations where it is, in fact, desirable to have an appreciable gap between the dots formed by the droplets on the substrate. The thus formed dots will lie on line at an angle to the direction of substrate movement. The dots formed by pairs within the array may nonetheless be aligned in a print line direction on the substrate, with the dots within each pair at an angle to the print line direction so that an image may therefore be formed from a plurality of 'diagonal pixels'. The angle may preferably be 30 or 45 degrees, and—in some embodiments—the angle may differ between pairs. These 'diagonal pixels' may advantageously be arranged and spaced so that printing from all chambers results in a checkerboard pattern. Such an arrangement may prove useful in forming shading or dithering patterns.

Further, such flexibility may also allow different volumes of fluid to be ejected from the two chambers; this may for example be accomplished by altering the relative amplitudes and timings of the two first and second square waves. As each pair of chambers is effectively an isolated system, they may be considered separately, and so once a waveform is developed that allows a pair to release droplets of two specific volumes, this same waveform may also be applied to other pairs within the array at substantially the same time, so that the actuations of the pairs all overlap in time.

Furthermore, a 'family' of waveforms may be developed, each producing a pair of dots on the substrate with specific sizes. Pairs may then be selected within the array using a screening procedure and an appropriate one of the family of waveforms selected so as to produce two dots having appropriate sizes. As each pair of channels is isolated, the method will advantageously allow for the use of the same family of waveforms for any pair of chambers in the array whilst cross-talk is substantially prevented.

Further still, each member of the family of waveforms may be designed in such a way that the speeds of two such droplets of different volumes are adjusted to align their landing positions perpendicular to the direction of substrate movement.

Such a 'family' of waveforms allows each pair to form dots on the substrate having various combinations of dot sizes, dot sizes being known in the art as grey-levels. The screening processes displayed in FIGS. 7 and 10 may be adapted to take account of the number of grey-levels available for each chamber in a pair.

It will be appreciated by those skilled in the art that while the methods displayed in FIGS. 7 and 10 concern just black and white pixels (a binary image), the method may easily be extended to pixels having any number of grey-levels. This of course holds true even for situations where it is only possible to deposit a pair of droplets of the same size, though the amount of error that the screening process must distribute will be much greater. As will be apparent, the greater flexibility in the droplet volumes of a pair, the smaller the error will be that must be distributed so that the difference will be one of degree rather than principle.

FIG. 15 shows a voltage signal adapted for use in a method according to a still further embodiment of the present invention. Whereas the embodiment of FIG. 14 consisted of only one positive square wave portion and one negative square wave portion, the present embodiment consists of a plurality of such square wave portions. The square waves each cause the release of a droplet of fluid from the apertures of the respective fluid chambers to form a growing train of conjoined droplets at the aperture, but crucially do not impart sufficient energy to cause the break-off of the train until the final actuation.

According to this embodiment the number of square waves may thus be approximately proportional to the total volume of the train of droplets, with each successive square wave adding a further quantum of fluid; this again allows the development of a 'family' of waveforms having a range of dot sizes. In this particular embodiment the family may be constrained so that the number of positive and negative square wave portions may differ by at most one. This will cause an image formed using such a technique to consist of pixels having the width of two droplets, but with variable tone.

In such embodiments, each pair will alternate between releasing droplets of fluid from one chamber in the pair and the other chamber in the pair. The actuations for all pairs are made to overlap in time so as to minimise the length of a firing cycle. Each train of thus-released droplets will form a separate dot on the substrate, with the print weight or print density of the dot being positively related to the number of droplets making up the dot.

In order to synchronise actuations between pairs in the array there will be a predetermined maximum number of droplets N that each firing chamber may eject as a single train. It may be arranged that actuations for all pairs are aligned in time, for example so that the first or last droplets released by each pair are released simultaneously.

In more detail, the positive square wave portions shown in the embodiment of FIG. 15 are of shorter duration that the negative square wave portions and so impart less energy to the droplet growing at the first nozzle. The widths of the square wave portions are chosen as described above to ensure that the droplets released from the two chambers are aligned on the substrate.

FIG. 16 shows a further voltage signal adapted for use in a method according to yet a further embodiment of the present invention. The signal is substantially the same as that shown in FIG. 15 but with substantially similar positive and negative square wave portions. In this embodiment, the square waves are preceded by a shorter negative square wave pulse which does not immediately lead to ejection but generates acoustic waves within the second chamber that increase the energy of the droplet released from the second chamber. This extra energy may be utilised to align the two dots on the substrate, or, as mentioned above, to produce a controlled spacing between the two dots.

Further embodiments of the present invention may combine the variable pulse sizes of the embodiment displayed in FIG. 14 with the variation in number of pulses shown in FIG. 15. This will again enable the two dots produced by the pair of chambers to be aligned on the substrate, or for their spacing to be suitably controlled.

In still further embodiments, a firing chamber will always release the same number of droplets, and thus the size of the dots formed on the substrate is essentially fixed. While this clearly will not afford a variety of dot sizes to be produced on the substrate, as it results essentially in a binary printing process, it has been found that, in many cases, a train of droplets of a given volume will be formed and travel to the substrate more reliably than a single droplet of the same volume. Thus, where binary printing is acceptable, such a process will provide improved reliability with an attendant increase in printing through-put common to all embodiments.

While the above exemplary embodiments make reference to waveforms comprising square wave portions, it will be appreciated by those skilled in the art that waveform portions of various forms such as triangular, trapezoidal, or sinusoidal waves may be used as appropriate depending on the particular deposition apparatus.

As is discussed above, the present invention may be applied to both 'side-shooter' or 'end-shooter' type apparatus and more generally to any apparatus having an array of chambers separated by actuable walls.

Further, where reference is made to the grey-level of a pixel, it will be appreciated that this does not necessarily imply the use of black ink, nor of a pigment of any kind. For example a colour image may be considered a combination of cyan, magenta, yellow and black images and the tone of each pixel represented by a 'grey-level' in each of these four colours. More generally still, with regards to the fluid droplets, grey-level is only intended to represent the volume of the droplet and does not concern the nature of the fluid itself. Of course, while the invention may have particular benefit in graphics applications where a printed image is formed of pigment or ink using an inkjet printer, the advantages of the present invention will be afforded with many types of droplet deposition apparatus, substrate and ejection fluids, including the use of functional fluids capable of forming electronic components, uniform coating of large areas (e.g. varnishes) and the fabrication of 3 dimensional components.

The invention claimed is:

1. Method for depositing droplets onto a substrate, utilizing an apparatus comprising:

an array of fluid chambers separated by interspersed walls, each fluid chamber communicating with an aperture for the release of droplets of fluid and each of said walls separating two neighboring chambers; wherein each of said walls is actuable such that, in response to a first voltage, it will deform so as to decrease the volume of one chamber and increase the volume of the other chamber, in response to a second voltage, it will deform so as to cause the opposite effect on the volumes of said neighboring chambers;

the method comprising the steps of:

receiving input data corresponding to an image;

applying an algorithm to said input data, the algorithm converting said input data, regardless of the image, to a representation of the input data made up solely of pairs of print pixels;

selecting pairs of adjacent fluid chambers based on said representation of the input data;

assigning said selected pairs of adjacent fluid chambers as firing chambers and the remaining fluid chambers as non-firing chambers, wherein one of said pairs of firing chambers is spaced apart from another of said pairs of firing chambers by an odd number of non-firing chambers; and for each of said selected pairs, actuating the separating wall of said pair of firing chambers so as to cause the release of at least one droplet from each of said firing chambers;

wherein said actuations of said selected pairs overlap in time.

2. Method according to claim 1, wherein each firing chamber within a selected pair releases a train of between 1 and N droplets dependent upon said input data, each such train forming a corresponding dot on the substrate.

3. Method according to claim 2, wherein the trains of droplets released by the firing chambers within a selected pair differ in droplet number by at most one.

4. Method according to claim 3, wherein each firing chamber releases a train of exactly N droplets (wherein N is an integer greater than 1), each such train forming a corresponding dot on the substrate.

5. Method according to claim 2, wherein said dots are disposed on a first straight line on the substrate.

6. Method according to claim 5, wherein said input data corresponds to a two-dimensional array of image data pixels, said dots on said first line being a representation of the values of a single line of image data pixels within said two-dimensional array.

7. Method according to claim 6, wherein any error inherent in the representation of one line of image data pixels by a line of fluid droplets is redistributed to another line of image data pixels.

8. Method according to claim 7, further comprising repeating said steps of selecting, assigning and actuating said fluid chambers so as to produce dots disposed on a plurality of further parallel straight lines on the substrate, each line being a representation of the values of a corresponding line of image data pixels within said two-dimensional array.

9. Method according to claim 1, wherein said actuations of the separating walls of selected pairs have a period of between 0.5 and 1.5 times the acoustic period for each chamber.

10. Method according to claim 1, wherein, for each selected pair, the two walls bounding the pair remain unactuated during the actuation of the separating wall of the pair.

11. Method according to claim 1, wherein all walls of unselected chambers are actuated in phase with each other so as to prevent the release of droplets.

12. Method according to claim 9, wherein said actuations of the separating walls of selected pairs are out of phase with the actuations of the walls of unselected chambers.

13. Droplet deposition apparatus comprising: an array of fluid chambers separated by interspersed walls, each fluid chamber being provided with an aperture and each of said walls separating two neighboring chambers; wherein each of said walls is actuable such that, in response to a first voltage, it will deform so as to decrease the volume of one chamber and increase the volume of the other chamber, in response to a second voltage, it will deform so as to cause the opposite effect on the volumes of said neighboring chambers, the apparatus being adapted to carry out a method according to claim 1.

14. Droplet deposition apparatus according to claim 13, wherein the apertures for substantially all fluid chambers are disposed on a line.

15. Method according to claim 2, wherein the trains of droplets released by the firing chambers within a selected pair are equal in droplet number.

* * * * *

UNITED STATES PATENT AND TRADEMARK OFFICE

CERTIFICATE OF CORRECTION

PATENT NO. : 8,567,923 B2
APPLICATION NO. : 13/127829
DATED : October 29, 2013
INVENTOR(S) : Drury et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 200 days.

Signed and Sealed this
Fifteenth Day of September, 2015

Michelle K. Lee

Michelle K. Lee
*Director of the United States Patent and Trademark Office*